US011120712B2

(12) United States Patent
Mitchell, Jr.

(10) Patent No.: US 11,120,712 B2
(45) Date of Patent: Sep. 14, 2021

(54) SYSTEM AND METHOD FOR DISPLAYING LED LOGOS

(71) Applicant: Paul T. Mitchell, Jr., Fort Worth, TX (US)

(72) Inventor: Paul T. Mitchell, Jr., Fort Worth, TX (US)

( * ) Notice: Subject to any disclaimer, the term of this patent is extended or adjusted under 35 U.S.C. 154(b) by 0 days.

(21) Appl. No.: 16/821,636

(22) Filed: Mar. 17, 2020

(65) Prior Publication Data

US 2020/0327832 A1 Oct. 15, 2020

Related U.S. Application Data

(63) Continuation-in-part of application No. 15/215,386, filed on Jul. 20, 2016, now abandoned.

(60) Provisional application No. 62/194,356, filed on Jul. 20, 2015.

(51) Int. Cl.
*G09F 21/04* (2006.01)
*G09F 13/22* (2006.01)

(52) U.S. Cl.
CPC ..... *G09F 21/04* (2013.01); *G09F 13/22* (2013.01)

(58) Field of Classification Search
CPC .. B60D 1/52; B60D 1/60; B60D 1/605; G09F 21/04; G09F 13/22
USPC ..... D12/162
See application file for complete search history.

(56) References Cited

U.S. PATENT DOCUMENTS 5,979,094 A * 11/1999 Brafford, Jr. ..... B60D 1/60 40/205
D430,519 S * 9/2000 Beauvais ..... D12/162
6,357,899 B1 3/2002 Craven
D491,509 S * 6/2004 Bundy ..... D12/203
D494,111 S * 8/2004 Peng ..... D12/162
7,347,597 B2 3/2008 French
7,717,455 B2 5/2010 Morris
D623,099 S * 9/2010 Wise ..... D12/162
D641,294 S * 7/2011 Edick ..... D12/162
9,434,225 B1 9/2016 Corsaut
2006/0209549 A1* 9/2006 Valdez ..... B60D 1/60 362/485
2007/0089337 A1 4/2007 Kehrberg
2011/0267187 A1* 11/2011 Swan ..... B60Q 1/305 340/467

(Continued)

OTHER PUBLICATIONS

Patent Cooperation Treaty; International Search Report; dated Jun. 3, 2021; 2 pages.

*Primary Examiner* — Cassandra Davis

(74) *Attorney, Agent, or Firm* — Whitaker Chalk Swindle & Schwa; Enrique Sanchez, Jr.; Carder W. Brooks

(57) ABSTRACT

A system and method for displaying LED logos and signs is disclosed. The method specifically allows for the display of LEDs from the exterior of a vehicle, utilizing different means of connection that are not contemplated in the art. The connection of the system to a vehicle can be facilitated via a trailer hitch receiver of a vehicle, a trailer outlet, a license plate receiving area, or other acceptable areas. The system can also allow for the interchangeability of LED displays for different events, such as sporting events, concerts, or in roadside emergency situations. The portability of the LED display can provide different use cases—vehicle mounting, over vehicle signaling, wall mounting, among others—that allow for an illuminated logo to be displayed by a user.

5 Claims, 12 Drawing Sheets

(56) References Cited

U.S. PATENT DOCUMENTS

| | | | |
|---|---|---|---|
| 2012/0090206 | A1 | 4/2012 | Prescott et al. |
| 2014/0070518 | A1 | 3/2014 | Sarajian et al. |
| 2015/0023009 | A1 | 1/2015 | White |
| 2017/0043711 | A1 | 2/2017 | Goeloe |
| 2020/0327832 | A1 | 10/2020 | Mitchell, Jr. |

* cited by examiner

SYSTEM AND METHOD FOR DISPLAYING LED LOGOS

INCORPORATION BY REFERENCE TO ANY PRIORITY APPLICATION

Any and all applications for which a foreign or domestic priority claim is identified in the Application Data Sheet (either filed with the present application or subsequently amended) are hereby incorporated by reference under 37 CFR § 1.57.

BACKGROUND

1. Field of the Invention

The present invention relates to a system and method for displaying LED logos, and more specifically to systems and methods for displaying LED logos on the exterior of a vehicle.

2. Background of the Invention

Owners of motor vehicles are often interested in decorating the exterior of their vehicles in ways that do not permanently modify the vehicles. Window paint, bumper stickers, license plate covers, hubcaps, and antenna toppers are all examples of such decorations that are known in the art. Owners often want to display support for a certain team, political candidate, or viewpoint with said decorations.

Many vehicles are equipped with trailer hitch receivers to enable the vehicles to tow trailers behind them. However, when not in use, trailer hitches can be unsightly, as well as a safety hazard. The hitches are often at the exact height of a person's shin, and often being made of metal, the hitches can injure unwary pedestrians. Therefore, when not in use, automobile owners often remove trailer hitches and leave the receivers bare. There are some attachments designed to utilize empty trailer hitch receivers, such as storage boxes, bike racks, etc. However, leaving these devices attached to the hitch receivers pose their own problems, and are not often left attached indefinitely. The receivers, and proximate electrical outlets, are then serving no purpose and remain unsightly as unadorned holes at the rear of the vehicle.

Like unoccupied trailer hitch receivers and trailer outlets, license plates on vehicles can also be unsightly; every vehicle is required by law to have at least one, and being tap to simply identify the vehicle, they are not meant to add any aesthetic value to the vehicle. As another way of decorating a vehicle and addressing the unsightliness of license plates, license plate covers have become more and more popular in recent years. License plate covers are stylized "frames" that circumscribe a license plate and allow for stylized attachment of the plate to a license plate receiving area of a vehicle. These covers are generally made of plastic or metal and can display a graphics or logos of car dealerships or favorite sports teams. However, at night, these covers are hard to see, and there is a need in the art for license plate covers that allow for decoration that can be seen at night and during the day, and that are more aesthetic in appearance.

SUMMARY

The present disclosure achieves technical advantages as a system and method for displaying LED logos beyond what is currently known in the art. Specifically, LED displays can be interchanged within in the system, allowing for versatility. The present disclosure additionally enables the display of LED logos from a trailer hitch as opposed to from an empty hitch receiver, eliminating the need to remove the trailer hitch from the receiver to display an LED device. The LED device can also not be static in position and can be displayed at a myriad of heights selectively adjustable by a user. The portability of the LED device provides different use cases—vehicle mounting, over vehicle signaling, wall mounting, among others—that allow for an illuminated logo to be displayed by a user.

Generally, trailer hitches are devices designed to fit into the hitch receivers and facilitate attachment of a trailer behind the vehicle. Hitches can consist of a hollow shaft of a certain size designed to fit into a receiver on an automobile, with a trailer ball disposed on the end of the shaft exterior of the receiver that a trailer can connect to. The trailer ball on a trailer hitch used for trailer attachment is often secured to the shaft of the hitch via a nut; the bottom of the ball has a threaded rod that extends downwards that fits through a horizontal hole on the end of the shaft, and a nut can be tightened onto the threaded bar to secure the ball to the hitch. Trailer hitch receivers are usually located under the rear bumper of the automobile and are of uniform sizes.

The hitches can be modular attachments that removably connect to automobiles via the receivers. The hitches and the receivers can have small holes that, when aligned upon insertion of the shaft of the hitch into the receiver, allow for a trailer hitch pin to thread through, thereby securing the hitch within the receiver. To remove the hitch, the pin is pulled out of the holes, and the hitch can be pulled out of the receiver. Near the hitch receiver, automobiles have outlets designed to receive wired plugs extending from trailers, and these outlets can supply power (statically—always, or dynamically—selectively) to trailer lights via a trailer power adapter or controller. The trailer power adapter or controller can be a standard component in a vehicle, or an aftermarket retrofit. While trailer outlets are generally the only outlets used by trailers, vehicles have other outlets disposed within the cab of the vehicle to supply electricity to different devices; most vehicles have several cigarette lighter outlets, and many have regular electrical outlets ("wall outlets") that are generally found in immobile structures.

In one embodiment, the present disclosure comprises a light apparatus for displaying an LED device from an exterior of a vehicle, comprising a display and a shaft. The display comprises an LED device operably coupled to a mount configured to support the LED device; a stylized cover coupled to the mount and overlaying the LED device; a plate secured to the back of the mount and configured to support the mount; a wire connected to the LED device on a first end and comprising a plug on a second end, wherein the plug is removably engaged with a vehicle outlet; and a shaft configured to engage a receiver. Holes in the shaft align with receiver holes in the receiver to allow insertion of a pin into the aligned shaft holes and receiver holes, to removably secure the shaft within the receiver. The shaft is removably coupled to the plate with an attachment mechanism and extends laterally from the display, wherein the wire of the display extends through and out of the shaft.

In another embodiment, the present disclosure comprises a light system for displaying an LED device from the exterior of a vehicle, comprising a telescopic hitch adapter and a display. The display comprises an LED device operably coupled to a mount configured to support the LED device; a stylized cover coupled to the mount and overlaying the LED device; a plate secured to the back of the mount and configured to support the mount; a wire connected to the LED device on a first end and comprising a plug on a second end, wherein the plug is removably engaged with a vehicle outlet; and a shaft configured to engage the telescopic hitch adapter. The shaft is coupled to the plate and extends downwards from the display. The shaft is removably coupled to the telescopic hitch adapter; and the telescopic hitch adapter is removably coupled to a trailer hitch.

In another embodiment, the present disclosure comprises a method for displaying an LED device on the exterior of the vehicle, comprising the steps of removably coupling a display to an exterior of a vehicle, and removably engaging the plug with the vehicle outlet. The display comprises an LED device operably coupled to a mount configured to support the LED device; a stylized cover coupled to the mount and overlaying the LED device; a plate secured to the back of the mount and configured to support the mount; and a wire connected to the LED device on a first end and comprising a plug on a second end, wherein the plug is configured to removably engage a vehicle outlet. The display is removably coupled to the exterior of the vehicle via a system selected from the group consisting of a shaft removably coupled to the plate and configured to engage a receiver of the vehicle; a rod permanently attached to the plate and configured to couple to a telescopic hitch adapter removably engaged with a trailer hitch; and a ring disposed on the display configured to facilitate removable coupling of the display to a license plate receiving area, wherein the display is configured to frame a license plate.

In another embodiment, the present disclosure comprises a light apparatus for displaying to an LED device from the exterior of a vehicle, comprising a display. The display comprises an LED device operably coupled to a mount configured to support the LED device; a stylized cover coupled to the mount and overlaying the LED device; a plate secured to the back of the mount and configured to support the mount; and a wire connected to the LED device on a first end and comprising a plug on a second end, wherein the plug is removably engaged with a vehicle outlet. The display is configured to frame a license plate of a vehicle, and the display is removably coupled to the exterior of the vehicle via a ring disposed on the display. The ring is configured to facilitate removable coupling of the display to a license plate receiving area.

DETAILED DESCRIPTION

The preferred version of the disclosure presented in the following written description and the various features and advantageous details thereof, are explained more fully with reference to the non-limiting examples included in the accompanying drawings and as detailed in the description, which follows. Descriptions of well-known components have been omitted so to not unnecessarily obscure the principle features described herein. The examples used in the following description are intended to facilitate an understanding of the ways in which the disclosure can be implemented and practiced. Accordingly, these examples should not be construed as limiting the scope of the claims. Specifically, any dimensions identified on any figures are preferred embodiments, and other embodiments can have different dimensions and capabilities, such that the dimensions should not be a limitation on the claims unless specifically recited therein.

The present disclosure provides at least the following benefits: 1) the ability to display a variety for lighted designs from the exterior of a vehicle; 2) designs can be interchangeable, such that a user can pick and choose which design to display at any given time; and 3) these designs can also be displayed from trailer hitch receiver by replacing the trailer hitch, displayed from a commercially available trailer hitch as opposed to replacing the hitch itself, or displayed from a license plate receiving area.

Figure 1:
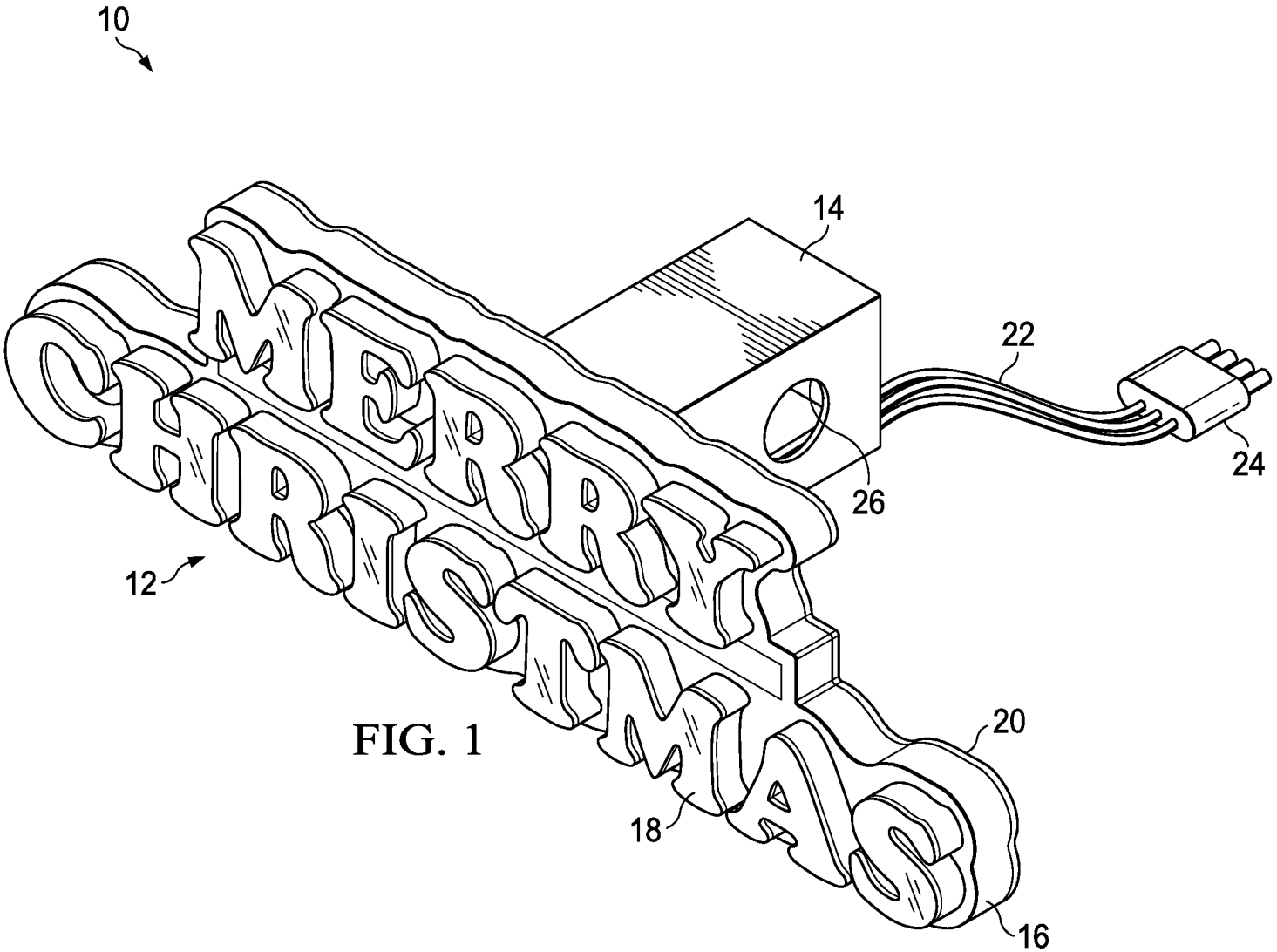
FIG. 1 shows one embodiment of the present disclosure, wherein the display of a light apparatus can be attached to a hollow shaft capable of being connected to the trailer hitch receiver of a vehicle.

FIG. 1 shows a light apparatus 10 that can be installed on the hitch receiver of a vehicle. The apparatus 10 has a display 12 and a hollow shaft 14 that, in this embodiment, extends laterally from the back of the display 12 and is designed to fit directly into a hitch receiver of a vehicle. The display 12 has an LED device (not shown) on a mount 16, here depicted as a hollow compartment. A stylized cover 18 can fit over the mount 16 and LED device, and the cover can have transparent, translucent, and opaque components, colored or not, such that when the LED device is activated, light can shine through the cover 18. The back of the mount 16 is attached to a plate 20 that is sized such that the surface area of the plate matches the surface area of the back of the mount 16, and at least one wire 22 that is connected to the LED device threads through holes in both the mount 16 and plate 20 and protrudes from the back of the display 12. The wire 22 is of such a length as to allow it to reach a trailer (or other) outlet on a vehicle when the light apparatus 10 is installed on the vehicle. In this embodiment, the display 12 is secured to the hollow shaft 14 with a permanent attachment mechanism (not shown in FIG. 1), such as welding, and the wire 22 extends through the hollow shaft 14.

A plug 24 at the end of the wire 22 can engage with a trailer outlet (not shown), or otherwise be designed to engage with another outlet of a vehicle, such as a cigarette lighter outlet or wall outlet. The plug can also be adapted to engage with a light bulb socket, such as one that receives a license plate light bulb on a vehicle, and be configured to allow a light bulb to couple to the plug, such that both the plug and the light bulb receive power from the light bulb socket. Alternatively, an adapter can be removably affixed to the plug to operably couple the plug to a power source, such as an AC/DC power source. Additionally, the light apparatus can be adapted to receive solar power, such as from a solar panel and a battery, capacitor, or other power-storing device, that the plug can be adapted to engage with. The hollow shaft 14 is equipped with holes 26 that allow for the securing of the apparatus 10 to a trailer hitch receiver with a trailer pin, or other suitable component. In this embodiment, the hollow shaft 14 protrudes from the display 12 in a straight line, such that the apparatus 10 extends from the vehicle at an elevation commensurate with that of the receiver it is installed within. In another embodiment, the shaft 14 can be curved, bent, or angled, such that the apparatus 10 can be displayed at an elevation not commensurate with that of the receiver it is installed within.

FIG. 2 shows the light apparatus 10 of FIG. 1, but the display 12 can be removably attached to the hollow shaft 14 with a temporary attachment mechanism. According to one embodiment, the attachment mechanism can be a draw latch.

Figure 2A:
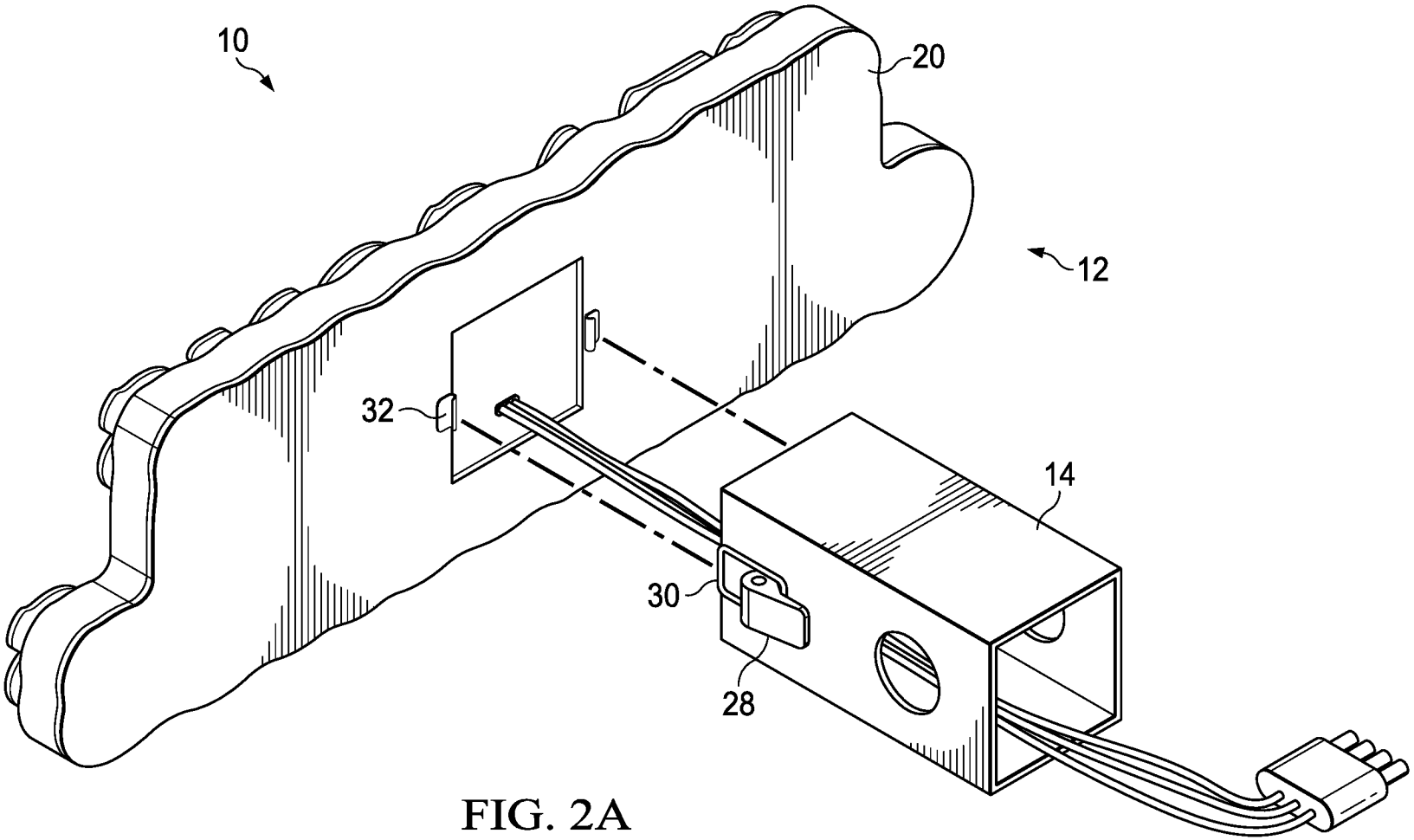
FIG. 2A shows another embodiment of the present disclosure, wherein the display of a a light apparatus can be detached from the hollow shaft and can be connected to the shaft temporarily.
Figure 2B:
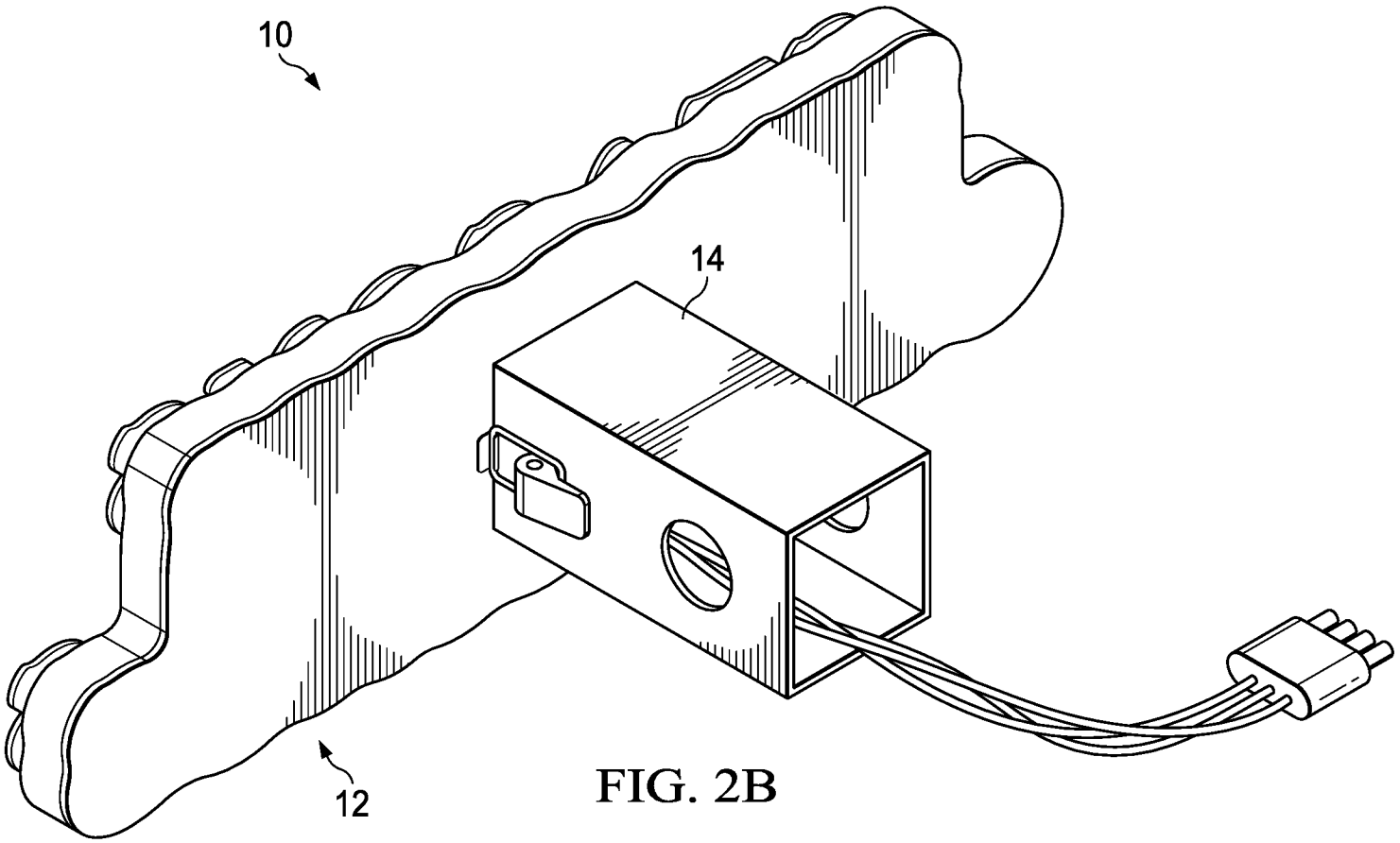
FIG. 2B shows the display removably attached to the hollow shaft, in accordance with another embodiment of the present disclosure.

FIG. 2A shows the display 12 detached from the shaft 14, and FIG. 2B shows the display 12 engaged with the shaft 14. As an exemplary embodiment, the hinge 28 and blade 30 of the draw latch is located on the hollow shaft 14, and the keeper 32 is located on the plate 20 of the display 12, such that the hinge 28 and blade 30 can engage the keeper 32 to secure the display 12 to the hollow shaft 14. Any attachment mechanism that can removably secure the display 12 to the shaft 14 can be used, including, deadbolt latches, spring latches, slam latches, cam locks, Norfolk latches, Suffolk latches, crossbars, and cabin hooks, or other suitable component. The attachment mechanism used can also be equipped with a locking mechanism to keep the display 12 secured to the hollow shaft 14. Additionally, there can be a padding material disposed on the plate 20 or the end of the hollow shaft 14 that cushions the contact between the plate 20 and shaft 14.

Figure 2C:
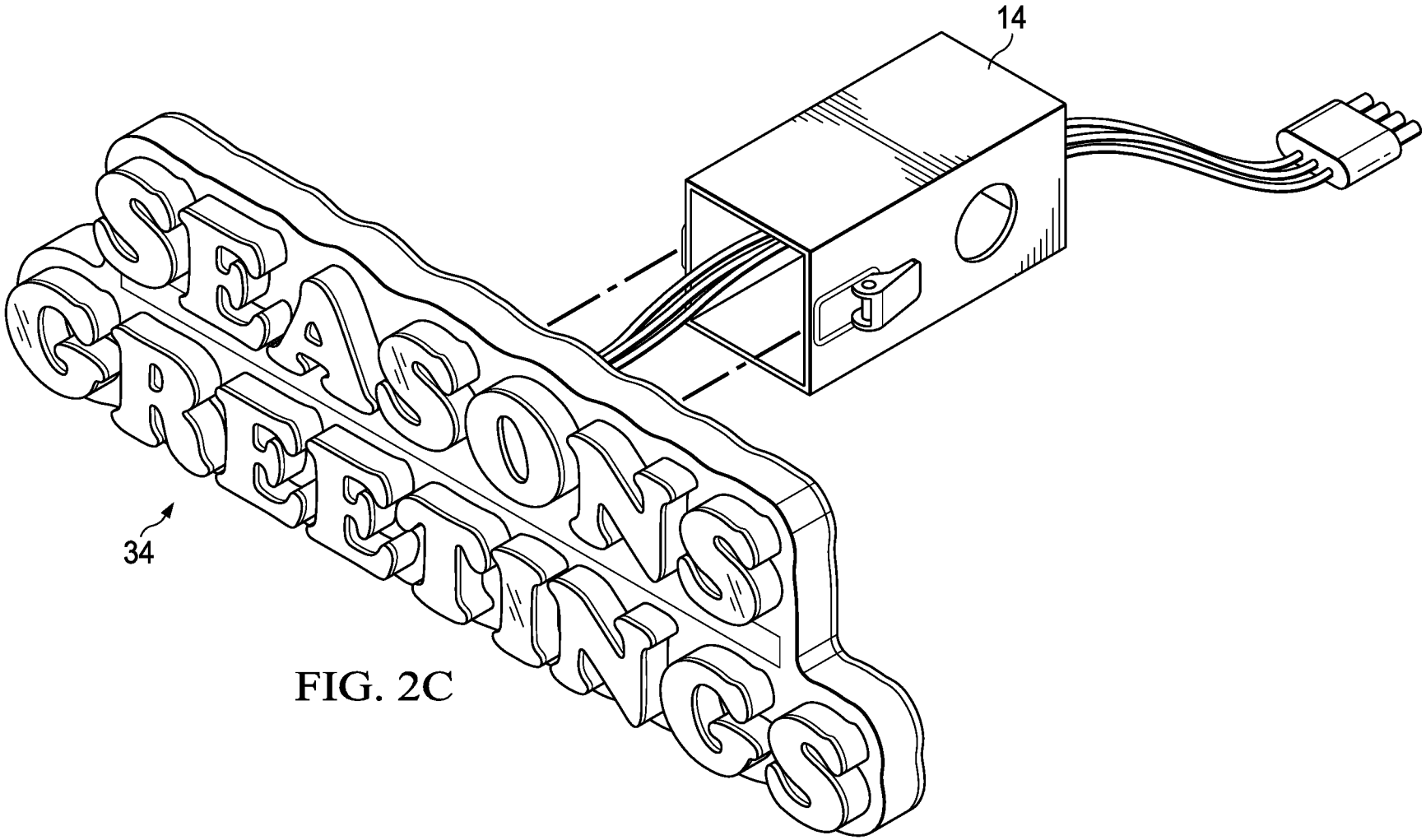
FIG. 2C shows the interchangeability of displays on the apparatus, wherein one display can be removed and replaced by a different display, in accordance with another embodiment of the present disclosure.

As can be seen from FIG. 2C, a different display 34 can be attached to the hollow shaft 14 when the first display 12 is removed. In one embodiment, the plate 20 of the display 12 has a raised lip sized to circumscribe the shaft 14 to add stability to the apparatus 10 when the display 12 is attached to the shaft 14. In another embodiment, the display 12 can further comprise a ring or rings (not shown) disposed at the top edge of the display 12 designed to receive, for example, screws or to nails, such that the display 12 (when detached from the shaft 14) can be hung, such as on a wall or from a ceiling. In another embodiment, the plate 20 has a hole or holes (not shown) configured to receive and removably couple to, for example, nail or screw heads, to enable the display to be hung, such as on a wall.

Figure 3A:
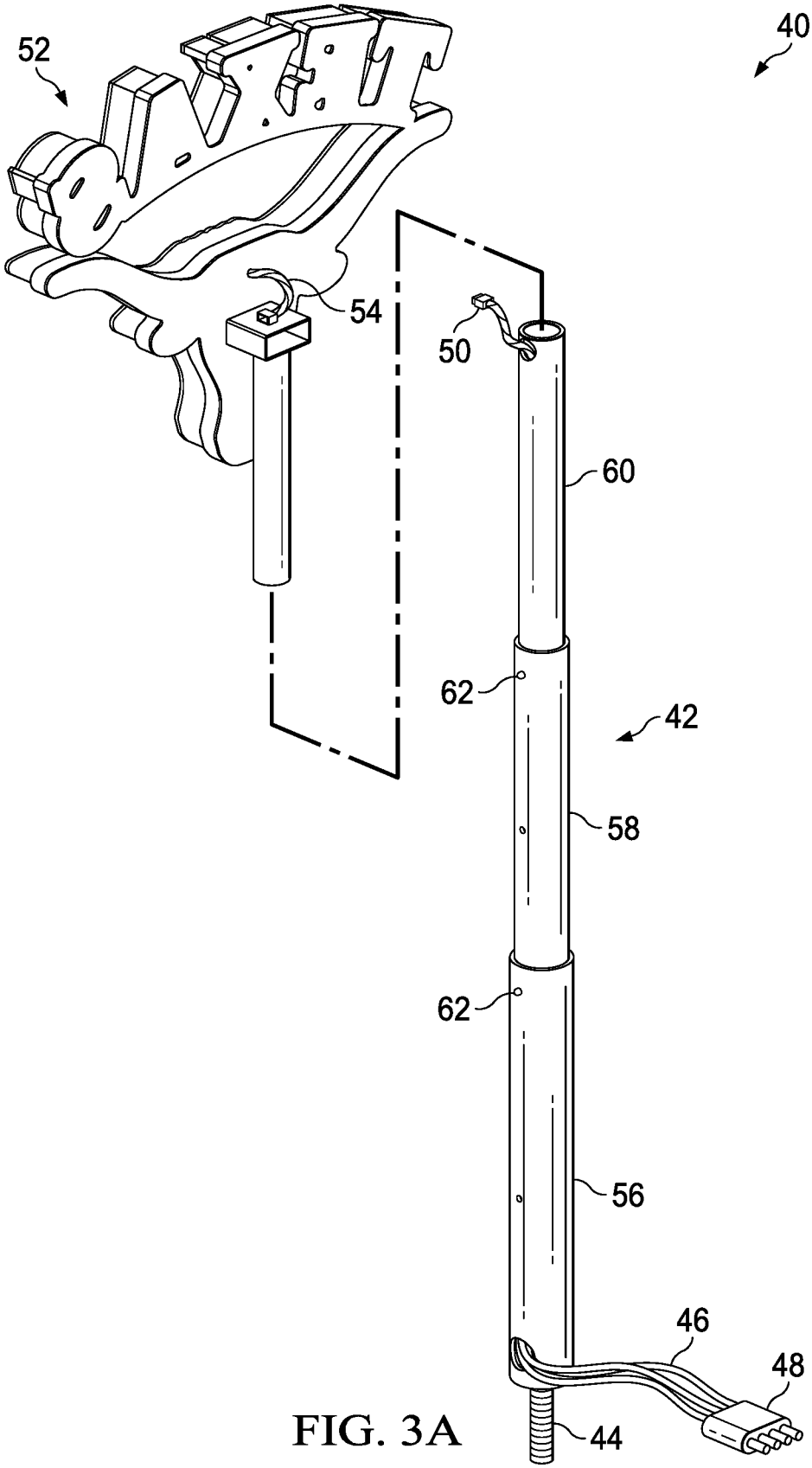
FIG. 3 shows another embodiment of the present disclosure, wherein a light system including a light apparatus disposed on a telescopic hitch adapter that can attach to a trailer hitch within a trailer hitch receiver of a vehicle.
Figure 3B:
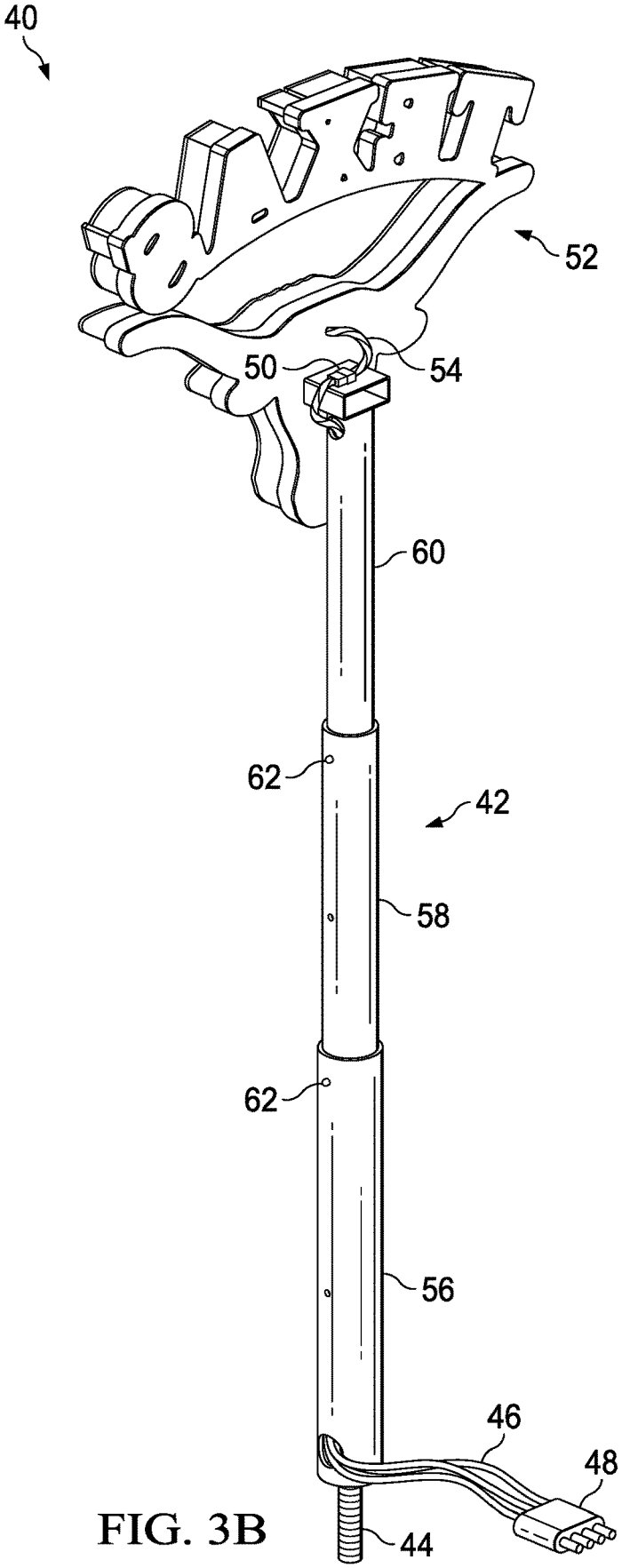

FIG. 3 shows a light system 40 capable of being installed on a trailer hitch, in accordance with another embodiment of the present disclosure. A telescopic hitch adapter 42 can have an attachment mechanism 44 (here, a threaded rod sized to receive the nut of a trailer ball capable of being inserted into a trailer ball hole, i.e. a hole in a trailer hitch that generally receives the rod extending from a trailer ball) to attach the adapter to the trailer hitch. The attachment mechanism can include any suitable mechanism or device capable of securing the adapter 42 to a hitch, including, but not limited to, the threaded rod discussed above, or a trailer ball receiver equipped with a cinching or tightening mechanism that secures the adapter 42 around a trailer ball (i.e. the end of the adapter 42 can fit over the top of the trailer ball, and an internal cinching or tightening mechanism can secure the adapter 42 and attached display 52 to the trailer ball such that the adapter 42 can be prevented from falling off of the trailer ball). The adapter 42 can have an extension wire 46 disposed within it with a trailer outlet plug 48 on one end and a counterpart plug 50 on the other end to engage with an LED display 52 similar to those shown in FIGS. 1 and 2.

Similar to FIGS. 1 and 2, the display 52 can have a hollow shaft or rod, but said shaft extends downwards and is capable of inserting into the top of the adapter 42. The wire 54 of the display 52 can exit the display 52 above the hollow shaft as shown, or alternatively, the wire 54 can exit out of hollow shaft (similarly to FIGS. 1 and 2) and engage the counterpart plug 50 of the adapter 42 such that the engaged wires 46, 52 remain within the adapter 42. Like with FIG. 2, the display 52 can be removed from the adapter 42 and replaced with a different display. The display 52 can be disconnected from the extension wire 46, and the hollow shaft can be removed from the top of the adapter 42, allowing a different adapter to subsequently be connected to the extension wire 46 and inserted into the adapter 42.

In another embodiment, the adapter 42 can be of any design that allows it to extend upwards to a maximum height and collapse down on itself to a set minimum height. In one embodiment, the telescopic hitch adapter 42 can extend above the roof of a vehicle. In one embodiment, the adapter 42 can have a bottom section 56 that can be slightly larger than the middle section 58, which is similarly slightly larger than the top section 60, allowing the middle and top sections 58, 60 to collapse into the bottom section 56. By collapsing or extending the sections 56, 58, and 60, the height of the adapter 42 can be varied. More or fewer sections can be added to vary the maximum height of the adapter 42. Additionally, the height of each of the sections 56, 58, and 60 can be predetermined to be appropriately sized for a vehicle, or other consideration. The adapter 42 can secure each section in its extended form with any means known in the art; in this exemplary embodiment, spring-loaded rivets 62 keep the middle section 58 secured and extended from the bottom section 56, and the top section 60 secured and extended from the middle section 58. The rivets 62 can be pushed inwards to allow the top section 60 and middle section 58 sections to collapse downwards into the bottom section 56.

Figure 4:
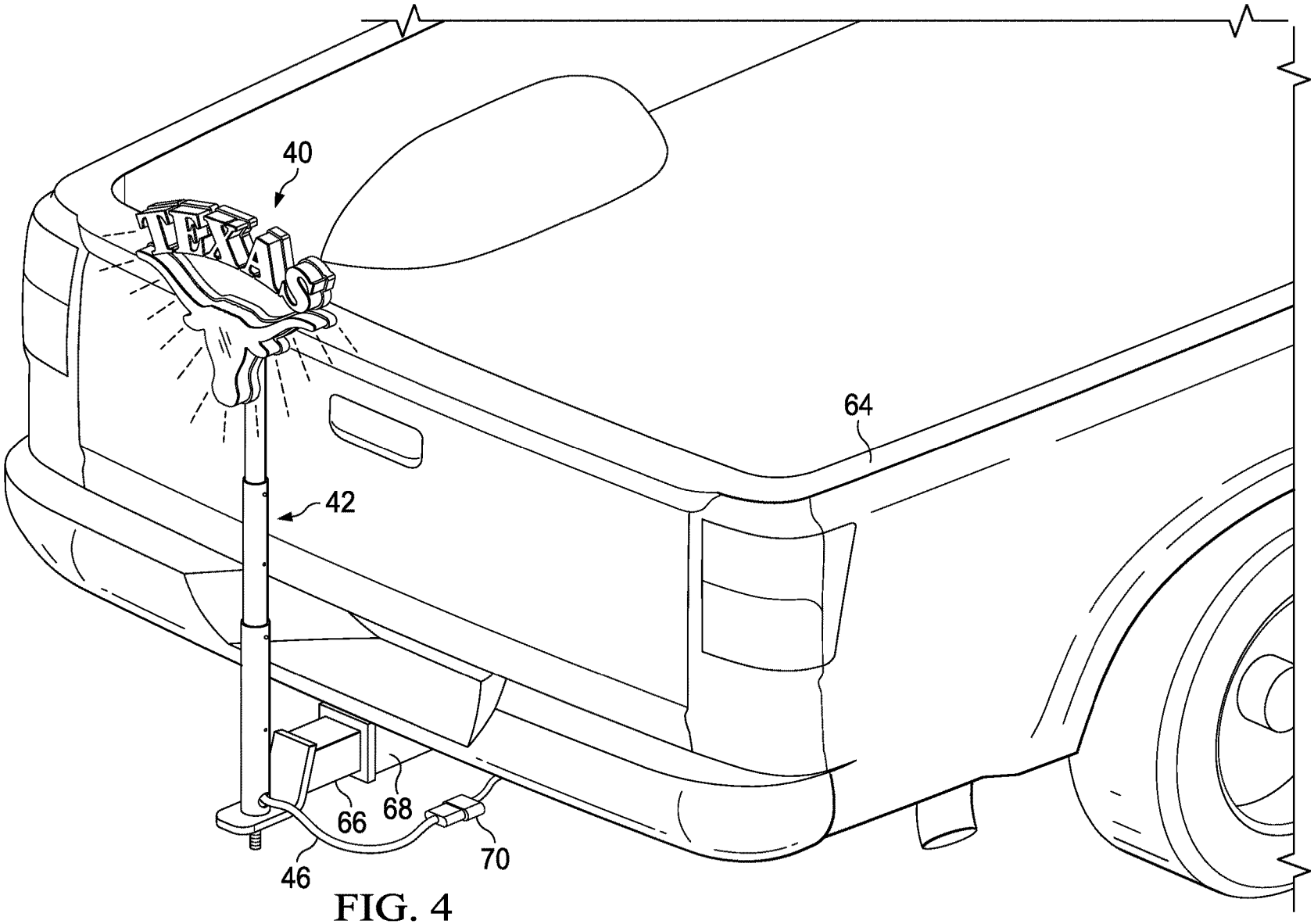
FIG. 4 shows the light system of FIG. 3 installed on a vehicle, in accordance with another embodiment of the present disclosure.

FIG. 4 shows the light system 40 of FIG. 3 installed on a vehicle 64, in accordance with another embodiment of the present disclosure. A trailer hitch 66 can be installed in the hitch receiver 68 of the vehicle 64, and the telescopic hitch adapter 42 can be attached to the hitch 66; the adapter 42 is either installed over the trailer ball via a trailer ball receiver like that discussed above, or the trailer ball is removed to allow for insertion of the threaded rod as discussed above. The extension wire 46 of the adapter 42 engages with the trailer outlet 70 on one end and the display wire 54 (not shown in FIG. 4) on the other end to power the system 40.

Figure 5:
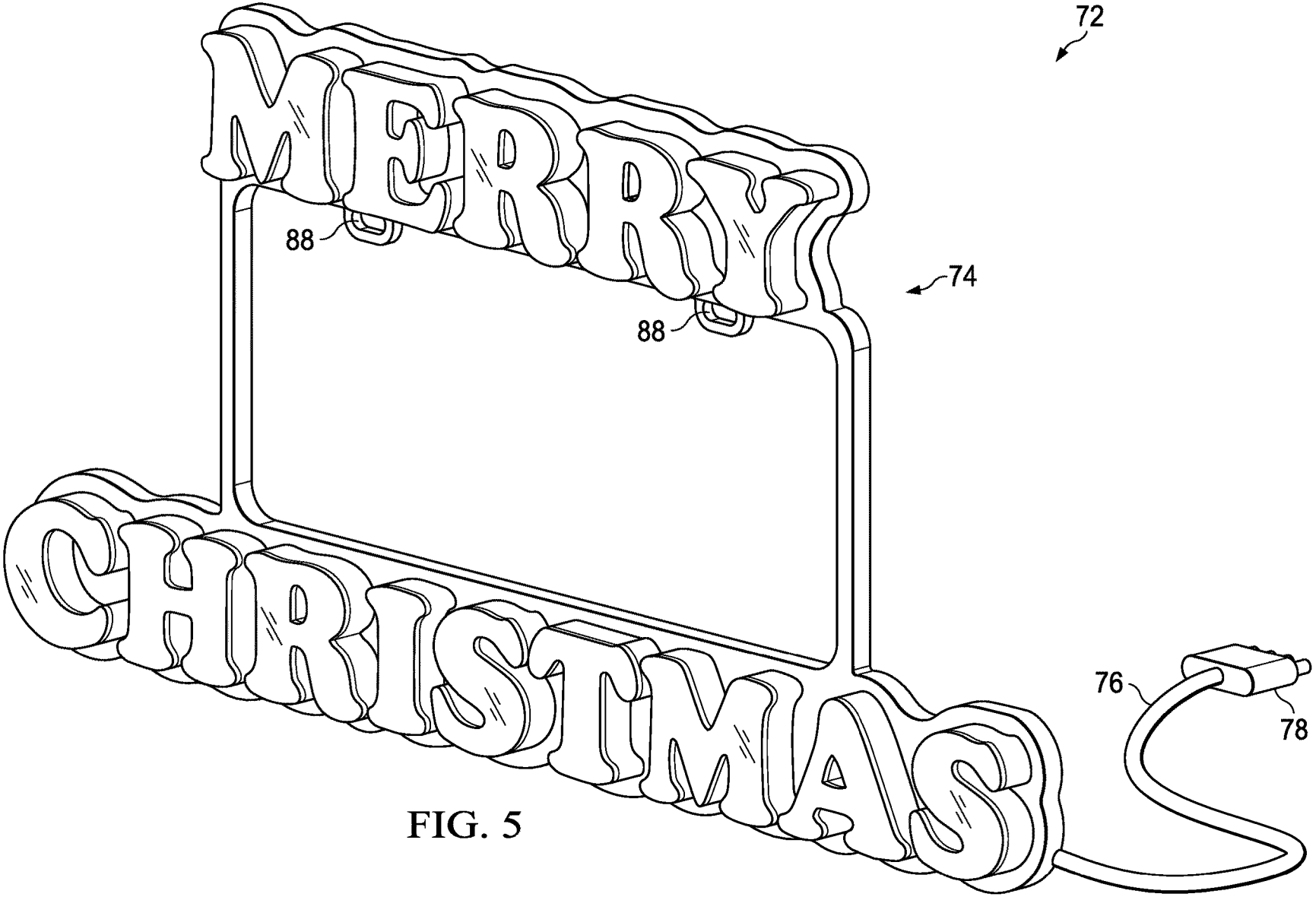
FIG. 5 shows another embodiment of the present disclosure, wherein alight apparatus can be a license plate cover that can attach to a license plate receiving area of a vehicle and be powered by an outlet of a vehicle.

In another non-limiting embodiment, FIG. 5 shows a light apparatus 72 similar to those depicted into FIGS. 1-4, wherein the display 74 can comprise the same components (i.e. an LED device, mount, plate, wire, and cover) but is instead sized to frame a license plate at a license plate receiving area of a vehicle, exterior to the vehicle. A wire 76 with a plug 78 extends from the display 74 and can attach into an outlet of the vehicle. The light apparatus 72 of FIG. 5 can be attached around the license plate of the vehicle by any conventional license plate receiving area attachment mechanism known in the art, including, but not limited to, adhesive backing or strips, clamps, latches, or most preferably, a ring configured to receive a screw such as those used to attach traditional license plate holders to vehicles. Here, the license plate receiving area attachment mechanism is a set of rings 88 that align with holes of the license plate receiving area of the vehicle to receive screws. In one embodiment, the light apparatus can be designed such that the display depicts words or images on either side of the license plate, as opposed to above and below the license plate. The light apparatus 72 can preferably be no more than ¼-½ inch thick.

Figure 6A:
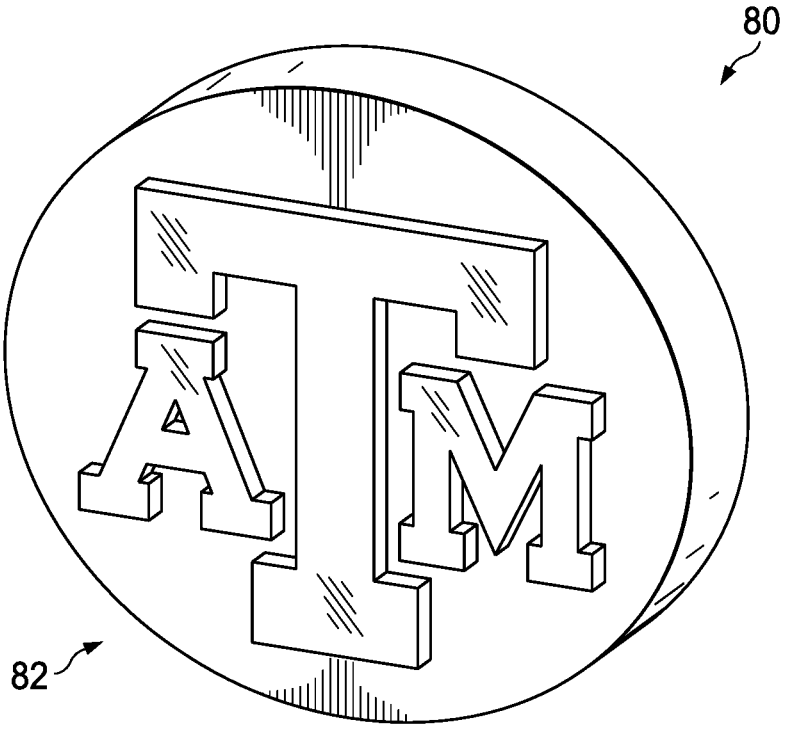
FIG. 6 shows another embodiment of the present disclosure, wherein the LED device of the light apparatus is powered by a battery, and a switch is disposed on the back of the display to turn the device on or off.
Figure 6B:
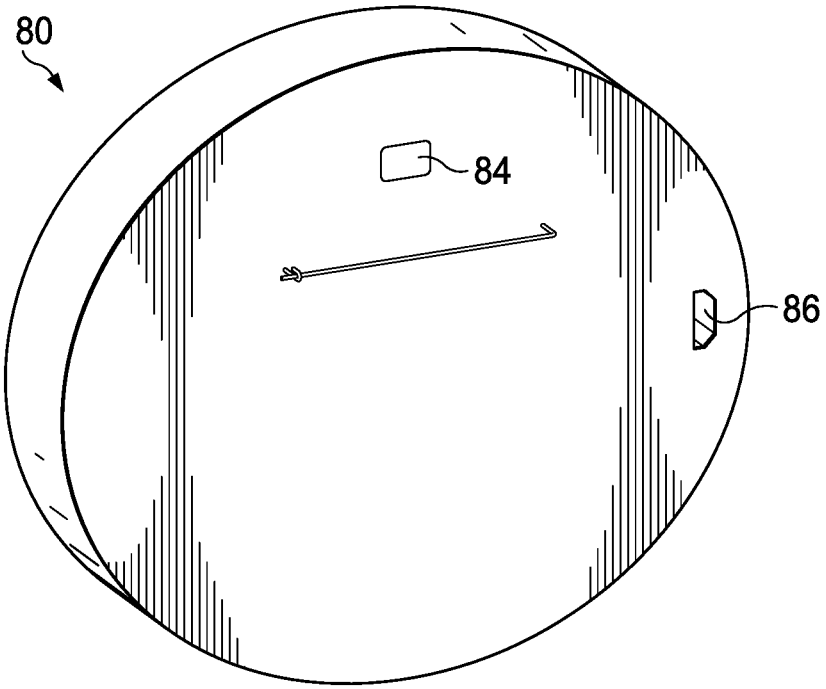

In another non-limiting embodiment, FIG. 6 shows a light apparatus 80 having a display 82 that is similar to the displays discussed in previous figures. The apparatus 80 here, however, has a battery (not shown) disposed within the display 82 to power the LED device, an on/off switch 84 disposed on the plate to control the LED device, and a charging outlet 86 that can receive any conventional charging cord, such as for a cell phone. The cord can plug into the charging outlet 86 on one end and into a vehicle outlet (like a trailer outlet) on the other end. The plate of the display 82 additionally has an attachment mechanism for securing the apparatus 80 to a desired target. The attachment mechanism can be a magnet such that the apparatus 80 can stick to the exterior of a vehicle. Or, as shown here, the attachment mechanism could be pin, such that the apparatus 80 can be secured to clothing. In one embodiment, the light apparatus 80 can be clearly view from 15-20 feet and display a soft illumination without any fuzziness.

In another preferred and non-limiting embodiment, FIG. 7 shows a light apparatus 90 similar to that of FIG. 1. A front view of the apparatus 90 can be seen in FIG. 7A, wherein a display 92 is connected to a hollow shaft 94 via a frame 104, shown here as being permanently attached to the display 92. Here, the display is split into two pieces (one component shown here displaying the word "Merry" and the other displaying the word "Christmas", notated as "Display Component A" and "Display Component B," respectively).

Figure 7A:
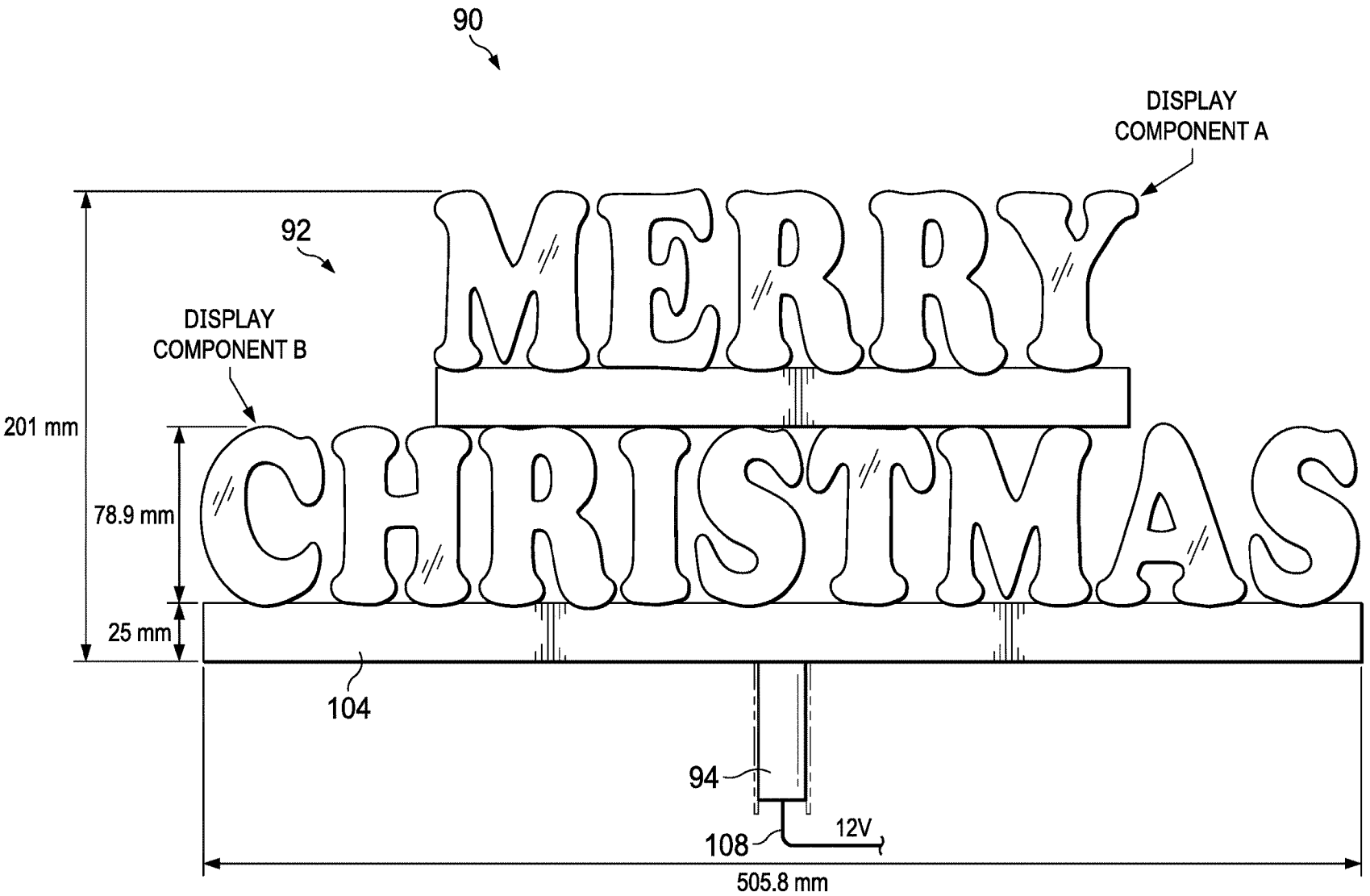
FIG. 7A is a front view of the light apparatus, in accordance with another embodiment of the present disclosure.
Figure 7C:
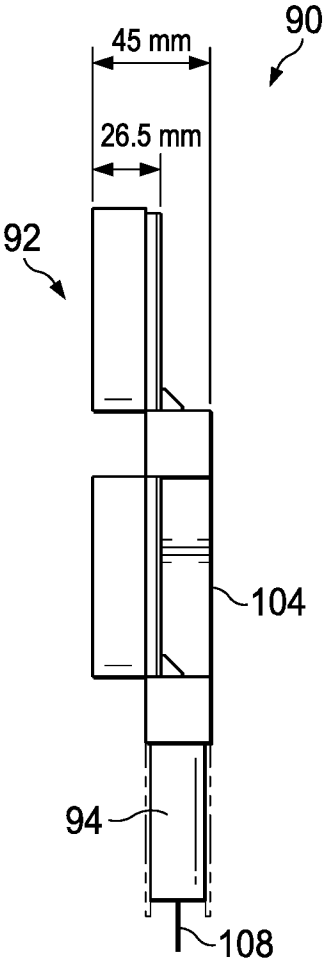
FIG. 7C is a side-view of the light apparatus, in accordance with another embodiment of the present disclosure.
Figure 7B:
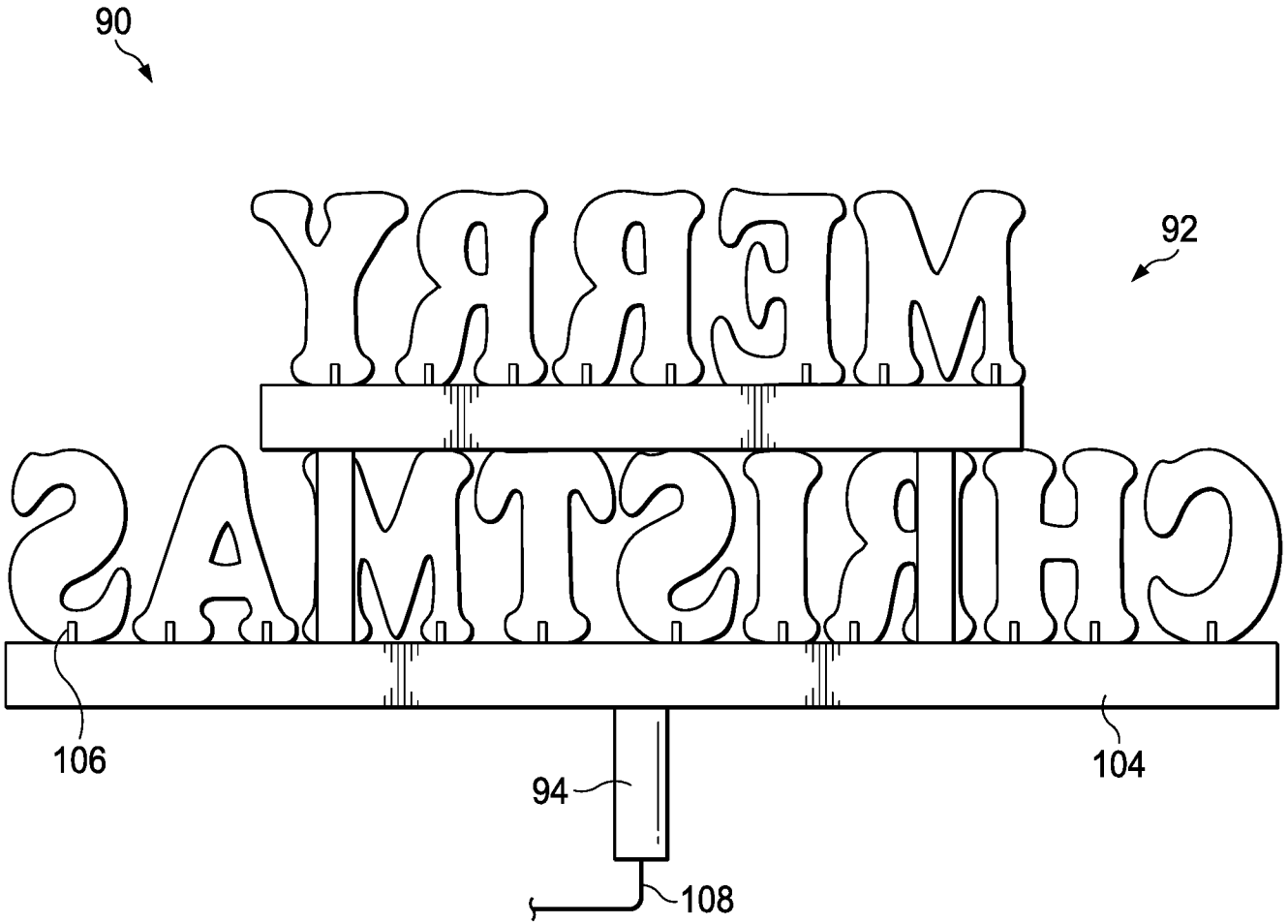
FIG. 7B is a rear view of the light apparatus, in accordance with another embodiment of the present disclosure.
Figure 7D:
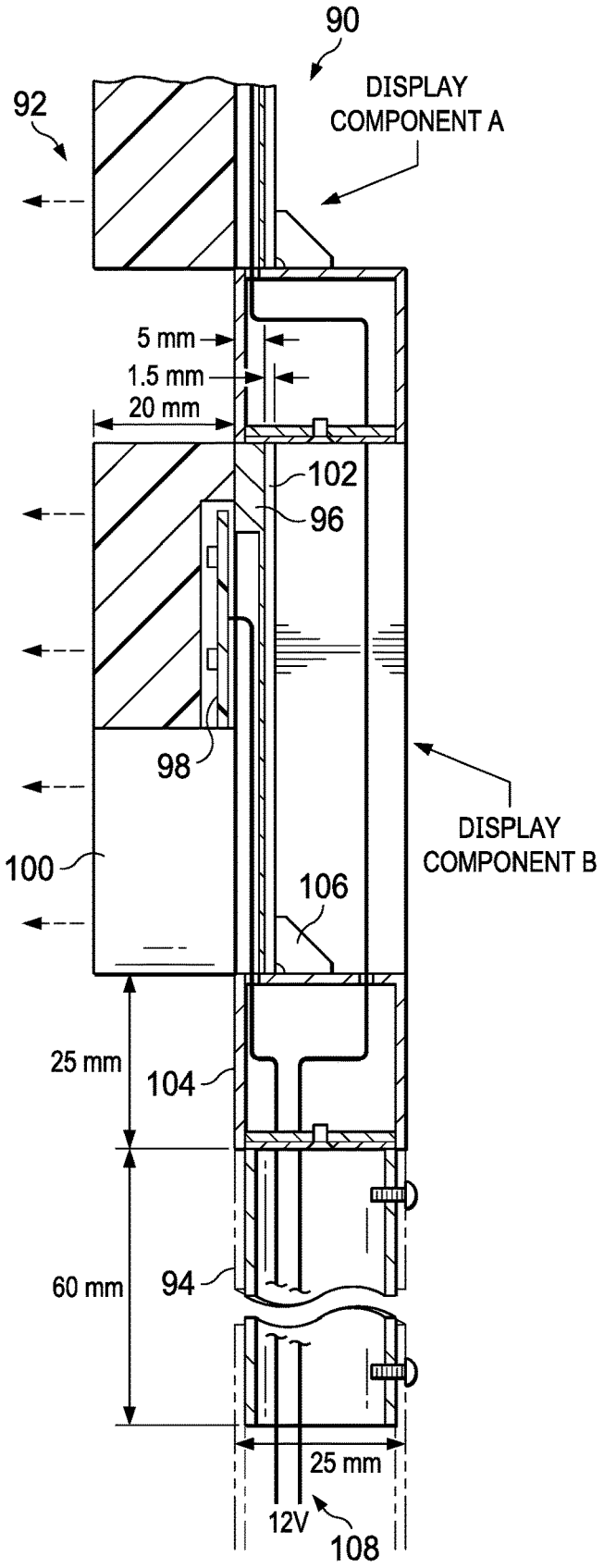
FIG. 7D is a cross-sectional side-view of the light apparatus, showing the inner components of the light apparatus, in accordance with another embodiment of the present disclosure.

FIG. 7B shows a rear view of the apparatus 90, wherein the frame 104 can be seen as being welded 106 to the display 92, and FIG. 7C shows a side view of the apparatus 90. FIG. 7D shows a cross-sectional side-view of the apparatus 90, wherein the components of the display 92 can be seen more clearly. An LED device 98 is disposed on top of a mount 96, depicted here as a slab, and a stylized cover 100 fits over the mount 96 and LED device 98 to allow the LED device 98 to shine in a stylized way therethrough. The mount 96 here (the slab) serves a similar purpose to that of the mount (hollow compartment) in FIGS. 1-6, except that the hollow compartment circumscribes and contains the LED device, and the slab here has the LED device 98 disposed on top of it, and the stylized cover 100 can fit over and around the LED device 98 with sides that circumscribe the LED device 98. The mount 96 can be disposed on top of a plate 102 that facilitates connection of the frame 104. The hollow shaft 94 is connected to the display 92 via the frame 104, and the frame 104 can be connected to the plate 102 of the display 92 via a attachment mechanism 106, shown here as a weld or welds 106. Wires 108 connect to each component of the display 92 through the mount 96 and thread out of the hollow shaft 94 to be plugged into a vehicle outlet.

In one embodiment, the mount 96 is a slab of ABS resin that is 5 mm thick; the plate 102 is stainless steel and 1.5 mm thick; the stylized cover 100 is a special luminance resin that is 20 mm thick with straight cut, with sides that are painted; the frame 104 is stainless steel and custom painted; and the hollow shaft is round and made of stainless steel. However, in other embodiments, these thicknesses can vary according to the application.

Figure 8:
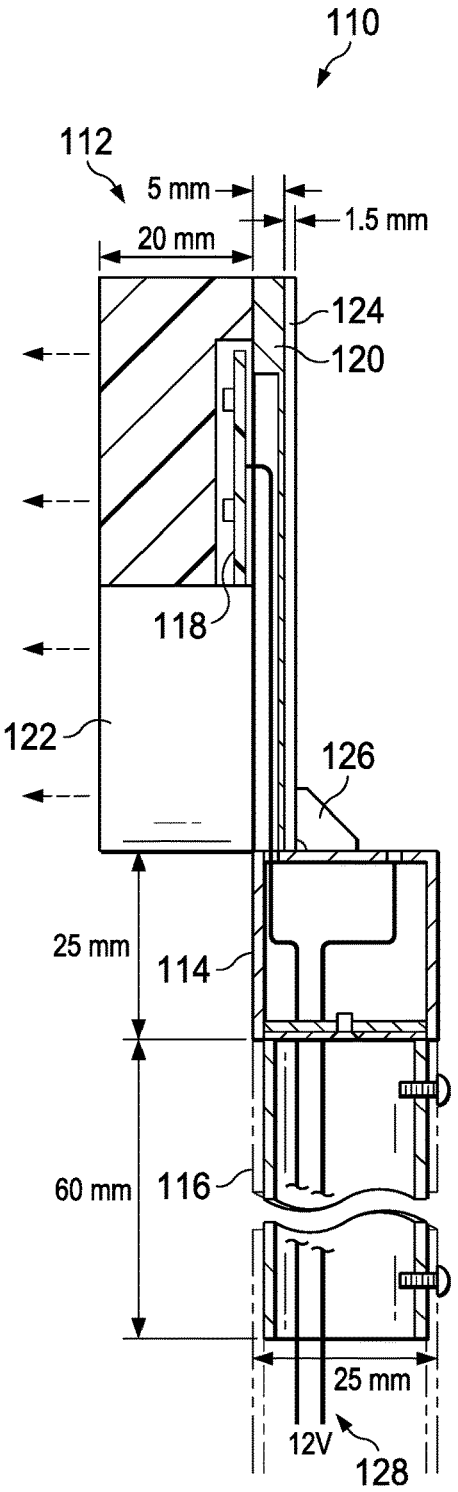
FIG. 8 is a cross-sectional side-view of the light apparatus, showing the inner components of the light apparatus, in accordance with one exemplary embodiment of the present disclosure.

FIG. 8 shows a cross-sectional side-view of a light apparatus 110 similar to that of FIG. 7, with a display 112 that is connected via a frame 114 to a hollow shaft 116, in accordance with another embodiment of the present disclosure. Unlike the apparatus of FIG. 7, however, the display 112 of the apparatus 110 here is made of only one component; i.e., if the apparatus 110 were viewed from the front, it would only have a single line of the display, such as "Merry" or "Christmas," but not both. An LED device 118 is disposed on top of a mount 120, depicted here as a slab like in FIG. 7, and a stylized cover 122 fits over the mount 120 and LED device 118 to allow the LED device 118 to shine in a stylized way therethrough. Like in FIG. 7, the mount 120 is disposed on a plate 124 to allow connection to the frame 114 via a attachment mechanism 126 (here, welding). The hollow shaft 116 is connected to the frame 114, and the frame 104 is welded to the plate 124 and thereby connected to the display 92. At least one wire 128 connect to display through the mount 120 and thread out of the hollow shaft 16 to be plugged into a vehicle outlet.

In these particular embodiments of FIGS. 7 and 8, the preferred thickness of the stylized covers 100, 122 are 20 mm; the preferred thickness of the mount 96, 120 are 5 mm; and the preferred thickness of the plates 102, 124 are 1.5 mm, such that the thicknesses of the entire displays 92, 112 are each 26.5 mm as seen in FIG. 7C. Additionally, the frames 104, 114 are preferably 25 mm thick, and the displays 92, 112 are disposed on the frames 104, 114 in such a way that the thicknesses of the entire apparatuses 90, 110 are 45 mm as seen in FIG. 7C. In this preferred embodiment, the apparatus 90 of FIG. 7 is 505.8 mm long and 201 mm tall (not including the hollow shaft 94). However, suitable alternative dimensions are contemplated.

For example, the stylized cover can be of any thickness as long as light can propagate therethrough; the mount can be of any thickness that allows the securing of the LED device to it; the plate can be of any thickness to support the display; the frame can be of any thickness to secure the display to the hollow shaft; and the hollow shaft can be of any thickness to allow it to attach to a trailer hitch receiver or telescopic hitch adapter. Additionally, the display can be of any desired height or any desired length. The hollow shafts 94, 116 of the apparatuses 90, 110 can alternatively extend laterally (as opposed to downwards) from the displays 92, 112 and be rectangular in nature to fit directly in a trailer hitch receiver, like in FIGS. 1 and 2.

The light apparatuses 90, 110 of FIGS. 7 and 8 can be attached to the trailer hitch receiver of a vehicle through an adapter, such as via a telescopic hitch adapter and attached trailer hitch disclosed herein. Alternatively, the hollow shafts 94, 116 of the apparatuses 90, 110 can be fitted with an attachment mechanism like that discussed for the telescopic hitch adapter (i.e. the bottom of the hollow shafts 94, 116 can have a threaded rod capable of receiving a nut, or alternatively be sized to fit over the trailer ball and have a means of securing the apparatuses 90, 110 to the trailer ball) and fit directly onto a trailer hitch.

In the embodiments discussed herein, using the trailer outlet of the vehicle is preferable, because the outlet is located nearest the display and it is on the exterior of the vehicle. However, other vehicle outlets can be used, including cigarette lighter outlets and wall outlets disposed within or outside of the vehicle. The wires that power the LED devices can be of any appropriate lengths to reach any of the outlets described herein. Additionally, multiple displays can be connected to a single hitch receiver, such as if the shaft were forked or split to allow attachment of multiple displays. All of the embodiments discussed herein are able to display a 3D effect or it otherwise have a certain depth in the lighting display; the stylized covers can be textured, colored, have raised and lowered surfaces, and otherwise be adorned in any way that allows the LED light disposed therebehind to illuminate the design through the cover. The cover, mount, and plate can work in concert provide depth or 3D effects to the embodiments, as the light from the LED device can be reflected off of the mount and plate and otherwise be refracted or shine through the cover to show the desired design. Additionally, the hollow shaft can be shaped, angled, or fashioned in such a way as to secure the light apparatus at a myriad of positions or angles. For example, the hollow shaft could be L-shaped, such that the display is positioned above or below the plane of the trailer hitch receiver.

In the embodiments disclosed herein, it is contemplated that the LED device of the light apparatus be attached to the mount in any way known in the art. For example, the LED device could be attached to the mount with adhesive, screws, or any other means that would successfully secure the LED device to the mount. Additionally, the stylized cover can be secured to the mount in any way known in the art, preferably with a type of adhesive.

In one embodiment, regarding the LED display, such display is intended to produce a soft, bright illumination to be viewable from 25 feet away with a clear definition of the lettering and/or image enabled by the stylized cover. The depictions of the stylized cover are separated with adequate spacing such that illumination from one section of the cover will not interfere with illumination from any other section. The stylized cover is configured to camouflage the interior of the display and contained LED device while enabling the display to emit illumination with clarity that defines the image and lettering of the stylized cover. In one embodiment, two LED devices can be used, and the lettering or display images of the stylized cover will not interfere with one another or otherwise blur the display of the device; such embodiment is viewable from 25 feet away while not blaring to the naked eye. An exemplary embodiment of the device is intended for use in all weather conditions and maintains clarity in such elements.

In one embodiment, the illumination of the light apparatuses can be static and unchanging, or conversely, the illumination can modulate, pulse, or blink, all while maintaining clarity of the display when illuminated. In one embodiment, the material utilized, such as for the stylized cover or mount, would not change or modify colors of the LEDs in the LED device to ensure clarity in variant weather conditions. In one embodiment, components of the display, such as the stylized cover and mount, can be transparent or translucent to allow the LEDs to project the illumination through the tops and sides of the display, adding to the definition of the display at a distance and mitigating any blur or haziness.

The present disclosure achieves at least the following advantages:

1. Interchangeable LED displays that connect to the trailer hitch receiver;
2. Portable LED displays that provide different use cases—vehicle mounting, over vehicle signaling, wall mounting, among others.
3. Ability to display from a trailer hitch itself as opposed to removing the hitch to attach the display; and
4. Displaying an LED device from an adjustably elevated position at the rear of the vehicle.

Persons skilled in the art will readily understand that these advantages (as well as the advantages indicated in the summary) and objectives of this system would not be possible without the particular combination of structural components and mechanisms assembled in this inventive apparatus and described herein. The disclosure can be embodied in other specific forms without departing from the spirit or essential characteristics thereof. For example, each of the new structures described herein, can be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the inventions are established by the appended claims rather than by the foregoing description. All changes that come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A light apparatus for displaying an LED device from an exterior of a vehicle, comprising:

a display, wherein the display comprises:

an LED device operably coupled to a mount configured to support the LED device;

a stylized cover coupled to the mount and overlaying the LED device;

a plate secured to the back of the mount and configured to support the mount;

a wire connected to the LED device on a first end and comprising a plug on a second end, wherein the plug is configured to removably engage with a vehicle outlet; and a shaft configured to engage a receiver, wherein shaft holes in the shaft align with receiver holes in the receiver to allow insertion of a pin into the aligned shaft holes and receiver holes, to removably secure the shaft within the receiver;

wherein the shaft is removably coupled to the plate with an attachment mechanism and extends laterally from the display, wherein the wire of the display extends through and out of the shaft, wherein the attachment mechanism comprises a draw latch, and wherein a blade and hinge are located on the shaft, and a keeper is located on the display.

2. The light apparatus of claim 1, wherein the attachment mechanism further comprises a locking mechanism.

3. A method for displaying an LED device on the exterior of the vehicle, comprising the steps of:

removably coupling a display to an exterior of a vehicle, wherein the display includes:

an LED device operably coupled to a mount configured to support the LED device;

a stylized cover coupled to the mount and overlaying the LED device;

a plate secured to the back of the mount and configured to support the mount;

a wire connected to the LED device on a first end and comprising a plug on a second end, wherein the plug is configured to removably engage a vehicle outlet; and removably engaging the plug with the vehicle outlet;

wherein the display is removably coupled to the exterior of the vehicle via a system selected from the group consisting of:

a shaft removably coupled to the plate and configured to engage a receiver of the vehicle, wherein the shaft is removably coupled to the plate via a draw latch, wherein a blade and hinge are located on the shaft, and a keeper is located on the display;

a rod permanently attached to the plate and configured to couple to a telescopic hitch adapter removably engaged with a trailer hitch; and a ring disposed on the display configured to facilitate removable coupling of the display to a license plate receiving area, wherein the display is configured to frame a license plate.

4. The method of claim 3, wherein shaft holes in the shaft align with receiver holes in the receiver to allow insertion of a pin into the aligned shaft holes and receiver holes, to removably secure the shaft within the receiver.

5. The method of claim 3, wherein the draw latch comprises a locking mechanism.

* * * * *